United States Patent [19]

Sachs et al.

[11] 4,098,042

[45] Jul. 4, 1978

[54] BLOCK-FORM FOR USE IN REINFORCED CONCRETE STRUCTURES

[76] Inventors: Melvin H. Sachs, 5415 Fairway La., W. Bloomfield, Mich. 48033; Calvin Shubow, 30840 Running Stream, Farmington, Mich. 48024

[21] Appl. No.: 716,656

[22] Filed: Aug. 23, 1976

[51] Int. Cl.[2] ..... E04F 13/08

[52] U.S. Cl. ..... 52/383; 52/404; 52/576

[58] Field of Search ..... 52/576, 421, 427, 577, 52/606, 404, 503, 562, 381, 382, 383, 425, 615, 618

[56] References Cited

U.S. PATENT DOCUMENTS

| | | | |
|---|---|---|---|
| 1,785,067 | 12/1930 | Bemis | 52/562 X |
| 3,255,562 | 6/1966 | Altschuler | 52/427 X |
| 3,772,842 | 11/1973 | Barbera | 52/562 X |
| 3,885,296 | 5/1975 | Stout | 52/577 X |

*Primary Examiner*—Stephen J. Novosad
*Assistant Examiner*—Carl D. Friedman
*Attorney, Agent, or Firm*—Krass & Young

[57] ABSTRACT

A block used for forming reinforced concrete structures employs a number of thin-wall tubes supported in spaced parallel relationship to one another. The upper and lower ends of the tubes are supported by laterally extending sheet metal frames which leave the tube ends open. The upper frame has an upward opening channel shaped cross-section. A pair of wall panels which form the inner and outer wall surfaces of the completed structure sandwich the tubes and extend between the frames. The volume between the panels, exterior of the tubes, is filled with a lightweight thermal insulation. In the completed structure, the tubes are filled with reinforced concrete to form the columns for the structure and interconnected by horizontal reinforced concrete bond beams poured in the upper frame members.

12 Claims, 7 Drawing Figures

Fig-4
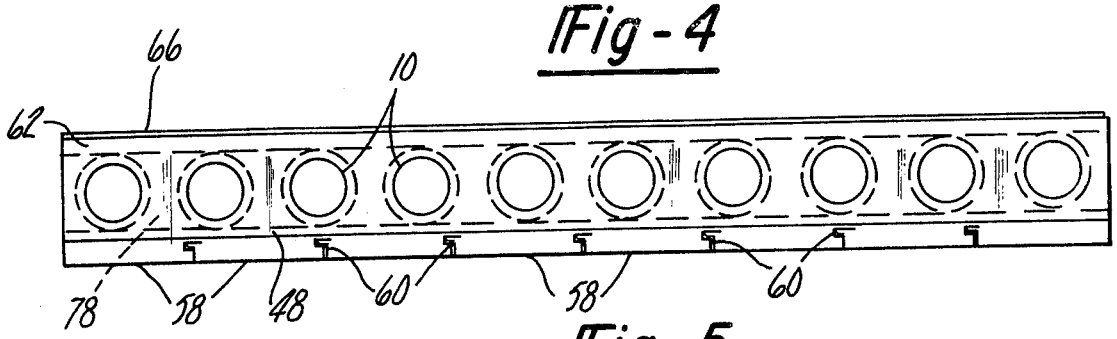
Fig-5
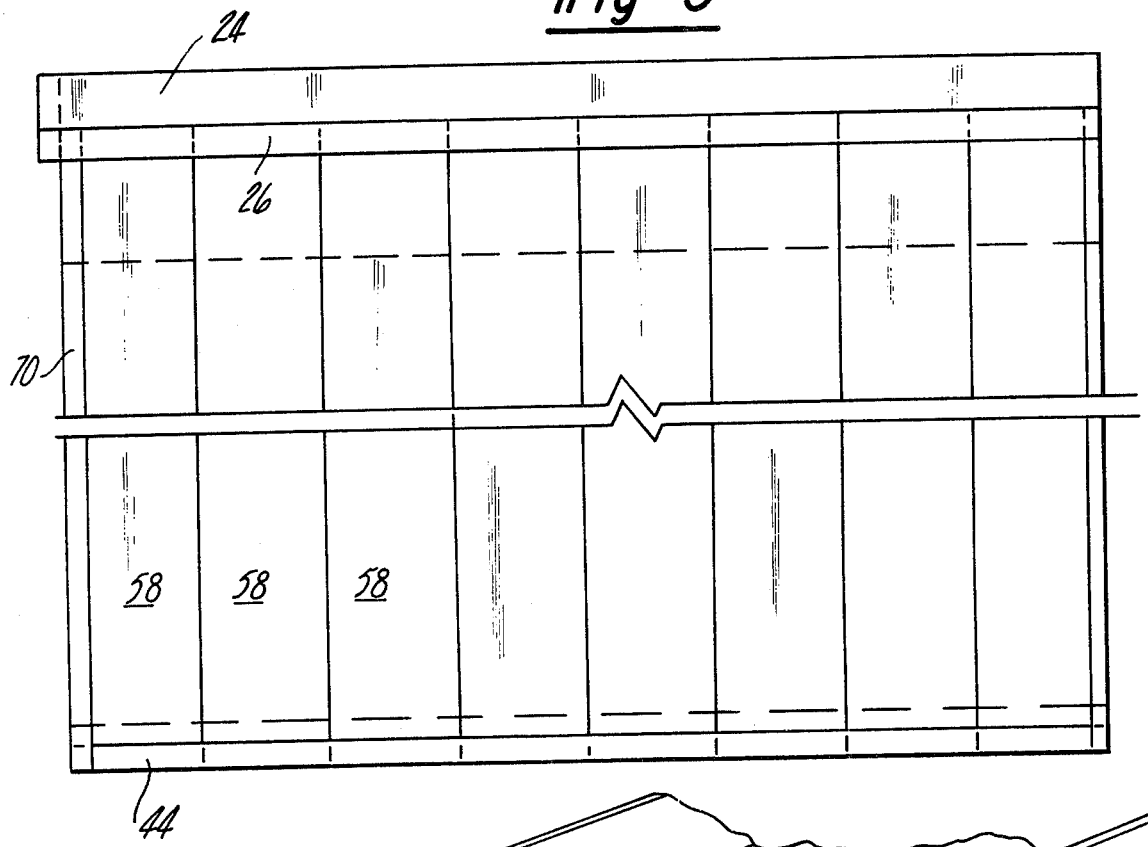
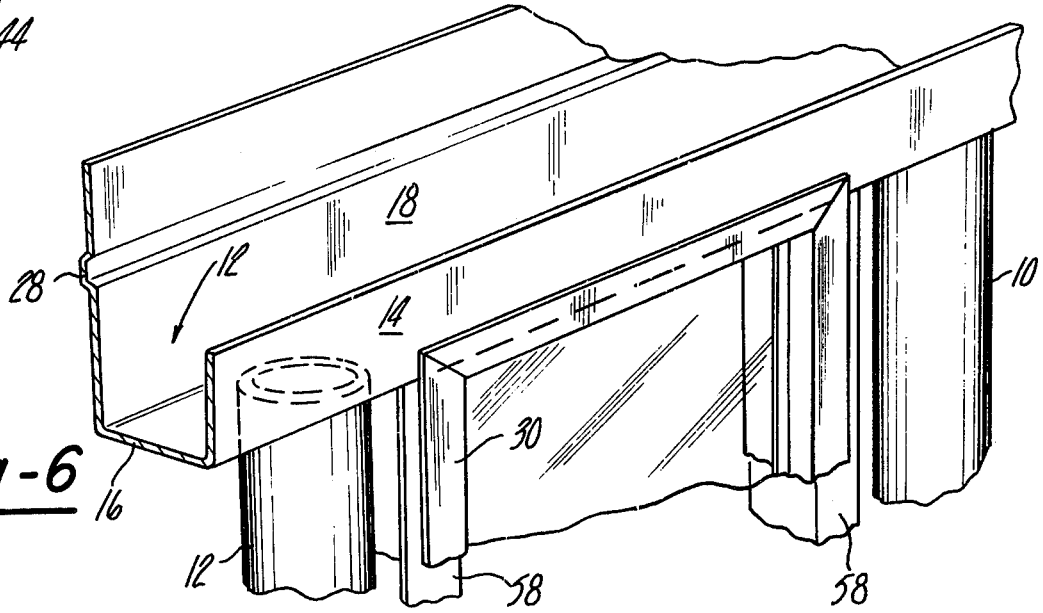
Fig-6

BLOCK-FORM FOR USE IN REINFORCED CONCRETE STRUCTURES

BACKGROUND OF THE INVENTION

1. Field of the Invention

This invention relates to permanent building blocks having voids which may be used to form a reinforced concrete framework extending through a plurality of the stacked blocks, and to a reinforced concrete structure employing such blocks.

So called "reinforced concrete buildings" typically employ a reinforced concrete framework including vertical columns and horizontal tying elements which cooperate to form a grid, and a superstructure providing inner and outer wall surfaces, insulation, vapor barrier and the like, supported on the framework. These structures have traditionally been formed by first erecting the reinforced framework using specially erected forms which often include reusable modules. After a section of the concrete framework had cured the forms were removed and the separate elements of the superstructure were successively joined to the framework. This method of construction involves a great deal of manual labor in erecting and dismantling the forms and mounting the separate superstructure components such as inner and outer wall surfaces, insulation, vapor barrier material and the like, on the reinforced concrete framework.

In recent years, a variety of building blocks have been proposed which are designed to provide the elements of a superstructure for a reinforced concrete building and also contain voids which act as forms for the erection of the concrete framework. These blocks may be stacked so that the voids in adjacent blocks are aligned. Reinforcing rods are inserted in the voids and then the concrete is poured. When the concrete cures, the wall structure is complete with the block material providing the inner and outer wall surfaces, the insulation, vapor barrier and the like. These blocks have the potential of providing an important saving in time and labor in the on-site construction of reinforced concrete buildings. U.S. Pat. No. 3,782,049 issued to one of the co-inventors hereof, discloses such a form-block molded from foamed plastic. The voids which receive the concrete are formed during the molding of the block and the block material provides excellent insulation in the finished structure. Inner and outer wall surfaces such as gypsum board and stone may be placed as inserts in the mold used to form the block or these materials may be attached to the block after molding. These blocks provide important advantages over more conventional methods of reinforced concrete construction, both in economies achieved during the erection and the energy conserving properties of the resulting structure, which are attributable to the excellent insulating properties of the foam plastics employed in the blocks; however, recent price increases in petroleum-based foam plastics, and more particularly in the fire resistant varieties which must be employed in highrise structures has severely limited the use of these blocks.

SUMMARY OF THE INVENTION

The present invention is directed toward a novel block-form that enjoys the advantages provided by the foam plastic blocks over conventional methods of reinforced concrete construction, but is substantially lower in cost, as well as to reinforce concrete structures incorporating these blocks. Broadly, the blocks of the present invention employ a plurality of spaced, parallel tubes; top and bottom frame members that support the tubes at their ends without blocking tube voids, and provide a trough structure for forming horizontal reinforced concrete bond beams; interior and exterior panels that sandwich the tubes; and insulation filling the volume between the panels externally of the tubes. These blocks are stacked in the same manner as the foam blocks to create vertical and horizontal voids used to form the reinforced concrete framework. The panels also remain in place after the frame is set to provide wall surfaces, insulation and the like.

In the foam blocks of the prior art the lightweight plastic either formed the void surface for receipt of concrete or supported thin walled tubes adapted to receive the concrete which tubes effectively reinforced the low strength plastic against the forces imposed by the concrete slurry. In the blocks of the present invention this supportive function is performed by the inner and outer wall panels themselves and the upper and lower frame members. Accordingly, the insulation has no structural role to perform and may take the form of various low cost, inorganic blanket type or granular materials which provide excellent thermal insulation and are fully fire resistant.

In the preferred embodiment of the invention, which will subsequently be disclosed in detail, horizontally extending furring strips are secured to the sides of the vertical tubes to retain the inner and outer panels. At least certain of the fasteners which secure the panels to the strips also pass into the interiors of the tubes, and are molded within the concrete frame to securely lock the system elements to one another.

Another embodiment of the invention, which will subsequently be disclosed in detail, take the form of a multi-story building employing the inventive blocks, in which the blocks have a height substantially equal to the height of one story in the building. The front panels used to form these blocks extend upwardly beyond the heights of the tubes for a short distance, so that the top edge of the rear panel is slightly below the top edge of the forward panel. In using these blocks to form a building after the tubes of a block have been filled with reinforced concrete a horizontal concrete beam bond is poured in the trough forming the upper frame member. This bond beam extends the full height of the rear panel but since the front panel edge is higher it terminates short of that edge. A floor slab, typically formed of hollow core precast concrete, which is to form the ceiling of the story just poured, is then supported with its edge on top of this horizontal bond beam and an additional pour is made between the rear side of the forward panel and the edge of the floor slab. This second pour bonds with the first pour and becomes part of the horizontal bond beam structure of the building. The next level of the blocks is then supported on top of this section and the concrete poured in the tubes of that block unites with this bond beam. In this manner the floor slab is formed integrally with the vertical and horizontal members of the concrete framework formed within the blocks.

Reinforced concrete buildings formed in accordance with the present invention may thus be erected more quickly and at a lower cost than conventional reinforced concrete structures and provide the permanent advantages of excellent thermal resistance. The system elements are completely interlocked by the concrete framework to prevent dislodgement during the life of the structure.

Other objectives, advantages and applications of the present invention will be made apparent by the following detailed description of preferred embodiments of the invention. The description makes reference to the accompanying drawings in which:

FIG. 4 is a top view of the block of FIGS. 2 and 3;

FIG. 5 is a front view, broken away at its mid-section, of the block of the present invention;

Figure 7:
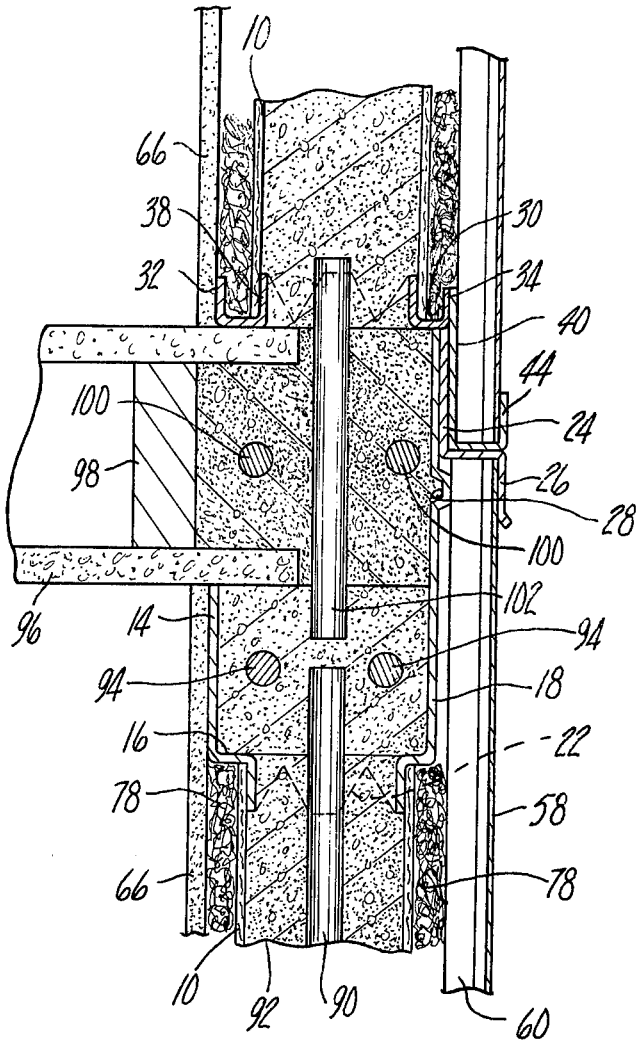

FIG. 6 is a perspective, detail, broken-away section through the upper framing member of a block formed in accordance with the present invention and incorporating a window; and FIG. 7 is a sectional view through a portion of a building structure formed in accordance with the present invention, illustrating the ends of two vertically aligned blocks and a floor slab joined to the concrete horizontal bond beam formed between the blocks.

The block illustrated in FIGS. 2–5 of the drawings has a central core formed of a plurality of thin-wall hollow tubes 10. Typically the tubes may be about 6 to 9 inches in interior diameter and may be formed of any self-supporting material such as cardboard which has sufficient tensile strength to withstand the forces imposed by a concrete slurry poured within the tubes. The tubes do not perform any structural function in the completed building structure, but only support the other panel elements in spaced relationship prior to formation of the concrete frame elements within the block, and act as forms for the pouring of the concrete. A typical block may employ 10 of the tubes 10 spaced on 10-inch centers. The tubes of the preferred embodiment will have a height of approximately 90 inches.

The upper ends of the tubes 10 are retained and spaced by a sheet metal upper frame member, generally indicated at 12. The frame member is J-shaped in cross-section with a relatively short upwardly extending rear wall 14, a horizontal base 16, and a relatively high vertically extending forward wall 18. The upper frame 12 may be formed of 16 gauge galvanized steel. The bottom wall has a plurality of apertures 20 formed with downwardly turned flanges 22 which extend into the open upper ends of the tubes 10, secure the tubes to the frame and space them relative to one another.

An elongated sheet metal upper retainer molding 24 is secured to the forward upper face of the frame 12 by sheet metal fasteners 25. The molding 24 extends the full length of the frame. The molding has a downwardly extending section 26 which is parallel to and spaced from the front surface of the frame section 18 and forms a groove for the reception of a front panel, as will be subsequently described. A forward extending ridge 28 formed in the front wall 18 of the frame 12 in opposition to the downturned wall 26 of the molding acts to space a supported front panel from the frame wall 18 as will be subsequently described.

The lower ends of the tubes 10 are secured in an elongated sheet metal lower frame member 30. The frame 30 has a shallow U-shaped cross-section, with short upturned rear and forward legs 32 and 34, respectively. Circular holes 36 surround by upturned flanges 38 which project into the lower ends of the tubes 10 are spaced along the bottom frame 30 at the same intervals as the holes 20 formed in the upper frame.

A lower sheet metal retaining molding 40 is secured to the front face of the forward upturned legs 34 of the lower frame 30 by sheet metal fasteners 42 and extends the length of the frame. It has an upturned forward face 44 spaced from its rear wall to form an upward facing groove adapted to retain a front panel in a manner which will be subsequently described.

An elongated sheet metal furring strip 42 extends the full horizontal width of the block across the front edges of the tubes 10. The strip 46 has a flange 48 that abuts the front faces of each of the tubes 10 and is secured to these faces by sheet metal fasteners 50 that pass through the walls of the tube and extend into the voids in the tubes. A horizontal web 52 on the strip supports a downturned flange 54 in spaced parallel relation to the faces of the tubes.

The upper retainer molding 24, the lower retainer molding 40, and the furring strip 46 are used to retain a front panel, generally indicated at 56, to the block. In the preferred embodiment the front panel takes the form of a plurality of vertically aligned sheet metal sections 58. The sections 58 have interlocking side edge configurations 60 which retain them together. Their upper edges are retained behind the downturned flange 26 of the upper retention molding 24. The ridge 28 abuts the rear edges of the lock sections 60 and forces the panel securely against the downturned flange 26.

In alternative embodiments of the invention the front panel could be formed of different materials, such as a single panel of synthetic stone or the like. An appropriate number of furring strips 48 may be provided on the forward face of the tubes, depending upon the nature of the front panel to be supported thereon. Similarly, the frames 12 and 30 could be formed of materials other than sheet metal, such as plastics or wood.

Three furring strips 62 similar in configuration to the front furring strips 48 are secured to the rear sides of the tubes 10 with fasteners 64 which project into the voids of the tubes. The three furring strips 62 are spaced at regular intervals along the height of the tubes. A rear panel 66 of the block is secured to the outer flanges of these furring strips 62, to the upturned rear flange 14 of the upper frame member 12, and to the upturned rear flange 32 of the lower frame member 30. Appropriate fasteners are used to retain the rear panel to these members.

Depending upon whether a block to be supported in lateral abutment to another block, or is to form an edge of a building structure, a sheet metal end frame member 70 having inturned flanges 72 and 74, may be used to close the end of the block. The front flange 72 secures to the lateral edge of the last front panel section 58 and the rear flange 74 secures to the rear panel 66.

The volume within the block, between the front panel sections 58 and the rear panel 66, exteriorly of the tubes 10, is filled with a lightweight, non-structural, non-combustible insulation 78. The insulation may be fibrous, such as "fiberglass", "mineral wool" or the like, or may be formed of pellets or beads. This insulation does not perform any structural function in the completed building. It is of a different nature and should be clearly distinguished from similar blocks which may be filled with concrete or the like, which is not primarily intended to perform an insulating function. The insulation 78 will preferably have a density of less than 15 pounds per cubic foot.

FIG. 6 illustrates a detail of a variation on the preferred embodiment of the block which retains a rectangular window frame 30. The frame is secured between a pair of spaced panels 58. The window frame defines the limits of the area containing the insulation 78.

FIG. 7 illustrates a cross-section detail at the joinder of a pair of blocks and an intermediate floor slab. In construction the lower block is first erected in an upright manner and then one or more steel reinforcing bars 90 are inserted into each of the tubes 10, preferably so that the ends of the bars project above the tops of the tubes. Concrete 92 is then poured into the tubes, preferably to the top level of the tubes.

After this is set horizontal reinforcing bars 94 are placed within the trough formed by the upper frame 12 and a second pour of concrete is made to fill the trough flush with the upper edge of the rear section 14. This pour preferably engages the upper end of the reinforcing bar 90 which extends upwardly from the tube 10. Next, a floor slab section 96 is laid on top of this second pour. In FIG. 7, the floor slab is illustrated as being tubular with a plug 98 inserted a short distance from its open end. Other forms of floor or roof slabs may of course be employed. The slab is positioned so that its forward edge falls intermediate the section poured in the upper frame 12, in opposition to and spaced from the upwardly projecting forward wall 18 of the frame. Preferably, the thickness of the floor slab 96 will be equal to the projection of the front frame section 18 above the rear frame section 14 so the top of the slab is level with the top of section 18. Horizontal reinforcing bars 100 are then secured within space between the forward end of the floor slab 96 and the rear edge of the frame section 18. Other reinforcing bars 102 project into or extend through the space from the lower concrete structure. Another pour is then made to fill this volume up to the top surface of the floor slab 96. The reinforcing rods which project upwardly from this space may extend into the lower ends of tubes 10 of the next tier of blocks.

Figure 1:
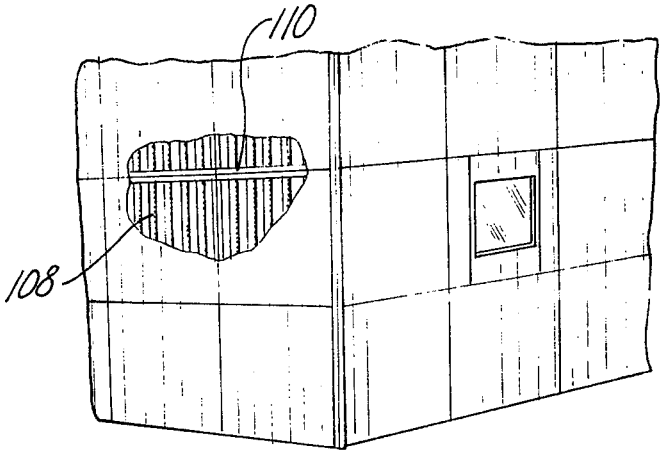
FIG. 1 is a perspective view of a corner of a building structure formed in accordance with the present invention, with a wall section broken away to show the interior construction.
Figure 2:
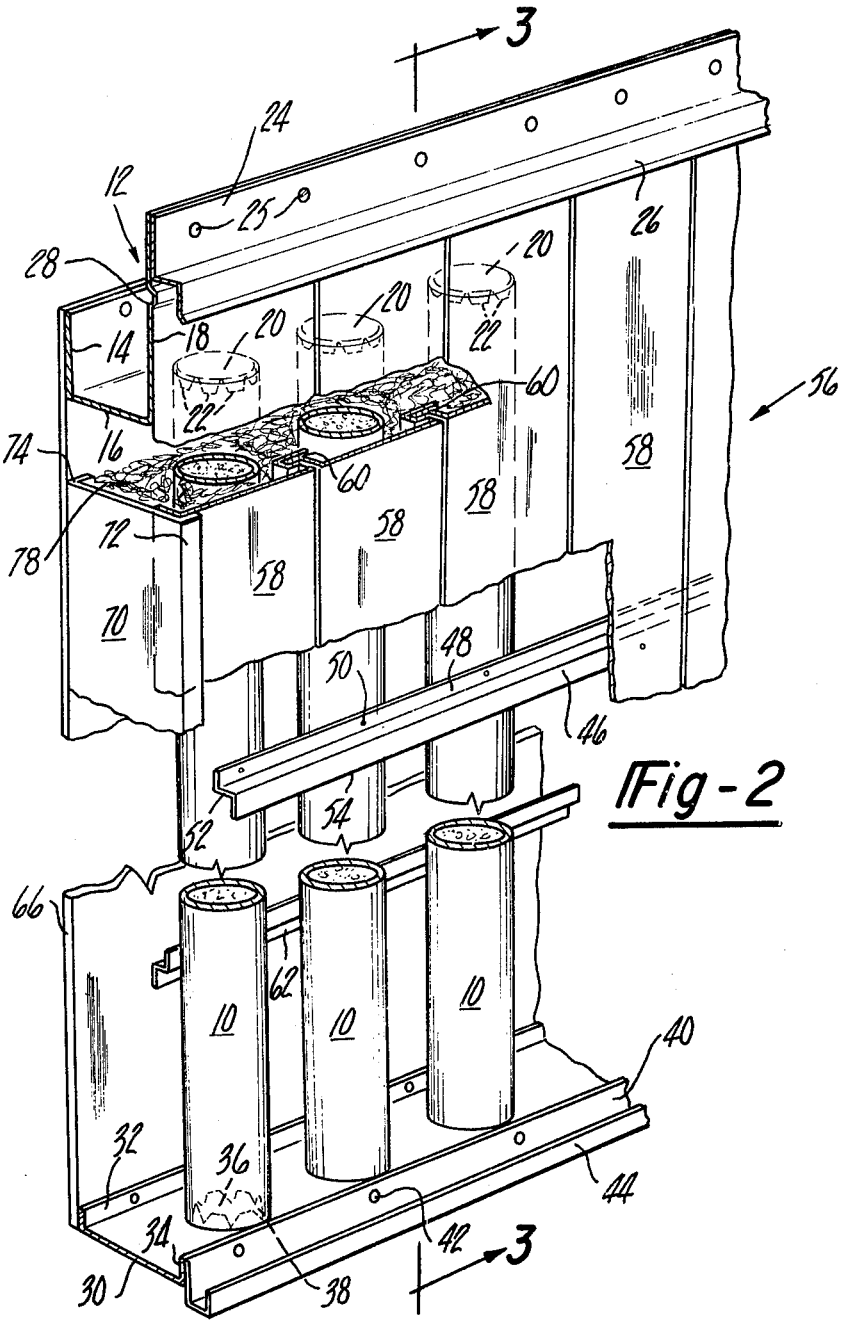
FIG. 2 is a perspective view, broken away for purposes of illustration, of a corner section of a block formed in accordance with the present invention.
Figure 3:
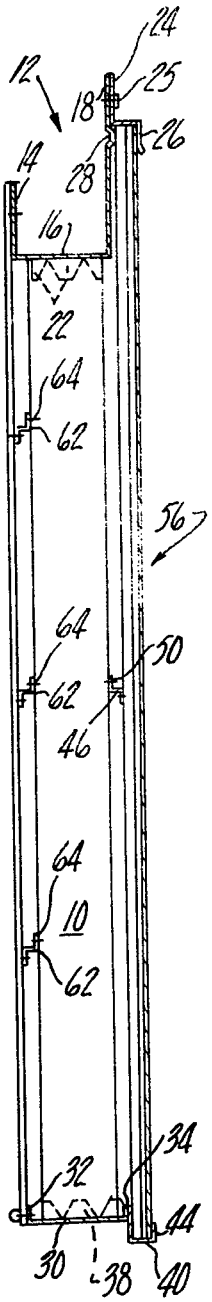
FIG. 3 is an end view of a block of the present invention.

A corner of a resulting structure is illustrated in FIG. 1. It will be seen that a grid is formed consisting of vertical reinforced concrete columns 108 formed within the tubes 10 and horizontal reinforced concrete bond beams 110 formed within the upper frames 12. The floor slabs 96 will be interlocked with these bond beam. The remaining block structure forms the superstructure upon this frame.

In alternative embodiments of the invention the blocks could be curved in horizontal section rather than planar. The panels could also have a variety of non-planar configurations for aesthetic or other reasons.

The embodiments of the invention in which an exclusive property or privilege is claimed are defined as follows:

1. A block for use in forming concrete structures comprising: a plurality of elongated rigid tubes disposed in spaced parallel relationship to one another; a top elongated frame member extending normally to the axes of the tubes connected to one end of each of the tubes; a bottom elongated frame member extending normally to the axes of the tubes and connected to the opposite end of each tube; parallel inner and outer wall panels having a height at least equal to the length of the tubes and a width in excess of the dimensions between the center lines of the opposite end tubes in said plurality of tubes, the panels being spaced from one another by a distance greater than the diameter of the tubes and being disposed on opposite sides of the tubes with their opposed faces spaced from the adjacent tube walls so that the volume between the panels encompasses the tubes; and insulation filling a substantial portion of the volume between the panels and exterior of the tubes, whereby a plurality of blocks may be supported in spaced relationship to one another and the tubes may act as forms for forming a concrete framework encased by the blocks which form wall surfaces thereof.

2. The block of claim 1 wherein the upper elongated frame member has a plurality of apertures which align with the opening in the tubes and the upper frame member includes a bottom and side wall adapted to receive concrete which, upon setting, bonds with concrete which may be disposed in said tubes to form horizontally extending elements of a building frame.

3. The block of claim 2 wherein the top and bottom frame members are formed of sheet metal and the apertures in the upper frame member are formed with downturned sheet metal flanges that extend into the interiors of the tubes.

4. The block of claim 1 including furring strips secured to the sides of the plurality of tubes to project normally to the axes of the tubes, and parallel to the plane containing the axes of the tubes, and wherein said panels are secured to the furring strips so that the furring strips space the opposed panel faces from the adjacent tube walls.

5. The block of claim 4 wherein the furring strips are secured to the sides of the tubes by fasteners which pass through the walls of the tubes and extend into the voids of the tubes so as to be secured therein by concrete poured within the tubes.

6. The block of claim 4 wherein the furring strips consist of elongated sections of metallic sheet bent angularly in cross-section to form a pair of separated parallel faces.

7. The block of claim 1 wherein the top edge of the outer wall panel is higher than the top edge of the inner wall panel, whereby flooring may be supported with its top edge in alignment with the top edge of the outer wall panel and supported on the top edge of the inner wall panel.

8. The block of claim 1 wherein the insulation has a density of less than 15 pounds per cubic foot.

9. The building of claim 1 wherein the panels are secured to the concrete columns by means of fasteners secured to the panels which pass through the walls of the tubes so that their ends project into the tubes and act as inserts molded within the concrete columns.

10. A building structure including: wall sections formed by a plurality of blocks, at least certain of the blocks including a plurality of elongated tubes supported in parallel spaced relationship to one another, an elongated upper frame member extending normally to the axes of the tubes and rigidly connected to one end of each of the tubes, an elongated lower frame member extending normally to the axes of the tubes and rigidly connected to the opposite end of each of the tubes, inner and outer wall panels having heights substantially equal to the length of the tubes and widths in excess to the distance between the centerlines of the two end tubes in the plurality supported on opposite sides of the tubes with the planes of the panels parallel to the axes of the tubes and the opposed sidewalls of the panels spaced from the adjacent walls of the tubes, to sandwich the volume including the tubes, and insulation filling a substantial portion of the volume between the panels and exterior of the tubes; and a concrete framework having portions formed within said tubes so that at least a substantial portion of the framework is enclosed within the blocks and the blocks form at least a portion of the wall surface of the building structure.

11. The building structure of claim 10 in which the structure comprises a plurality of stories and the blocks have a height substantially equal to the vertical height of a story.

12. The building structure of claim 11 in which the upper edges of the outer wall panels extend beyond the upper edges of the inner wall panels and further including floor slabs extending horizontally between at least certain vertically aligned panels, with the bottom edges of the floor slabs resting on the upper edges of the inner panels, and horizontal bond beams forming part of the reinforced concrete building frame poured between the opposed inner edges of the outer wall panels and the edges of the floor slab.

* * * * *